US007306350B2

(12) United States Patent
Lee

(10) Patent No.: US 7,306,350 B2
(45) Date of Patent: Dec. 11, 2007

(54) FIRECRACKER-LIKE LIGHT STRING

(76) Inventor: Hung-Wen Lee, No. 188, Shien Cheng 2nd Road, Chupei City, Hsinchu Shien (TW)

( * ) Notice: Subject to any disclaimer, the term of this patent is extended or adjusted under 35 U.S.C. 154(b) by 0 days.

(21) Appl. No.: 11/125,091

(22) Filed: May 10, 2005

(65) Prior Publication Data

US 2006/0256558 A1 Nov. 16, 2006

(51) Int. Cl.
*F21S 4/00* (2006.01)

(52) U.S. Cl. ..... 362/219; 362/222; 362/224; 362/806; 362/655

(58) Field of Classification Search ..... 362/219, 362/222, 224
See application file for complete search history.

(56) References Cited

U.S. PATENT DOCUMENTS

| | | | | |
|---|---|---|---|---|
| 7,052,159 | B2 * | 5/2006 | Wu | 362/252 |
| 2002/0097577 | A1 * | 7/2002 | Huang | 362/240 |
| 2003/0179575 | A1 * | 9/2003 | Huang | 362/252 |
| 2004/0136191 | A1 * | 7/2004 | Bluford | 362/249 |
| 2005/0225981 | A1 * | 10/2005 | Kirven | 362/249 |

* cited by examiner

*Primary Examiner*—Ali Alavi
*Assistant Examiner*—Evan Dzierzynski
(74) *Attorney, Agent, or Firm*—Rosenberg, Klein & Lee

(57) ABSTRACT

The invention relates to a firecracker-like light string, which includes bulb assemblies on both sides as a string of firecrackers. Blind wires are interconnected with the electrical wire to position the bulb assemblies on both sides of the electrical wires in secure. The string can be hung without other supporting frame to display a spiral firecracker-like decorative effect.

2 Claims, 3 Drawing Sheets

FIRECRACKER-LIKE LIGHT STRING

FIELD OF THE INVENTION

The present invention relates to a light string, which has an outlook as a string of firecrackers.

BACKGROUND OF THE INVENTION

A conventional light string is usually applied for decoration. Since the light string is made of soft material, it is difficult to pattern the light string to have a stable configuration. The known light string is always hung randomly or is supported by another patterned frame to display a certain outlook for decoration. That is the known light string cannot provide a decorative structure firmly by itself.

SUMMARY OF THE INVENTION

The present invention is to provide a light string having a firecracker-like outlook, which is completed by wires without any further patterned frame. It can be used or hung independently to obtain a better decorative effect. Now, accompanying with the following drawings, the character of the present invention will be described here and after.

DETAILED DESCRIPTION OF THE PREFERRED EMBODIMENT

Figure 1:
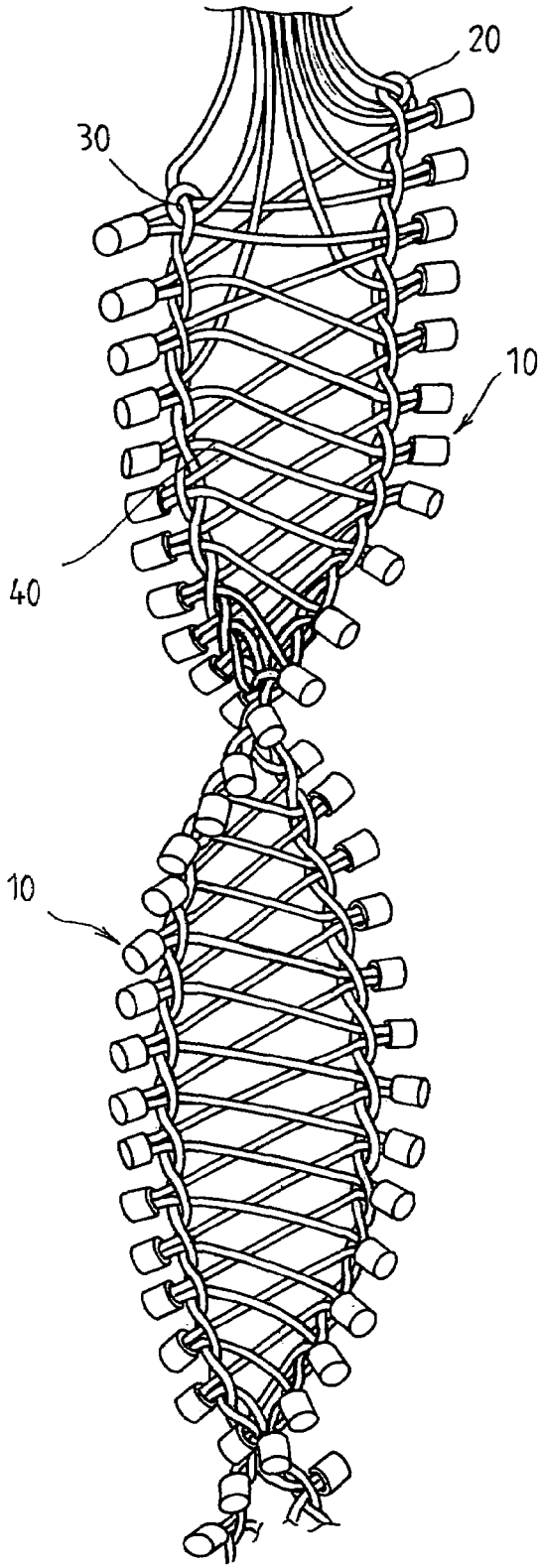
FIG. 1 is a perspective view showing a firecracker-like light string according to the present invention.
Figure 2:
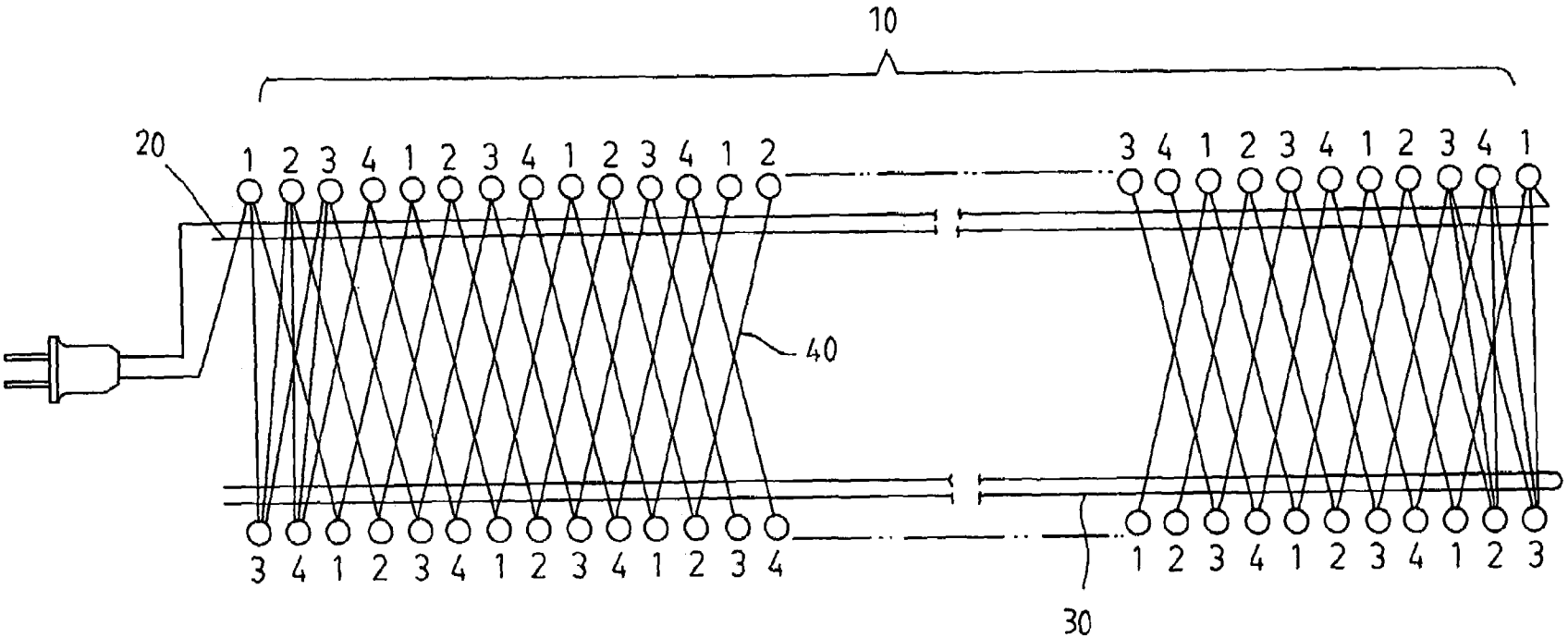
FIG. 2 is an illustrated plan view showing the connecting structure between wires of the light string according to the present invention.

Please refer to FIG. 1, the present invention relates to a light string having an outlook similar to a string of firecrackers, wherein the bulb assemblies (10) are placed on two sides of the string, which is therefore spiral with special decorative effect due to the gravity. The connecting structure of the light string is shown in FIG. 2, the bulb assemblies (10) are placed on two sides while a pair of blind wires (20) and (30) are interconnected with electrical wires (4) of the light string at inner portion relating to the bulb assemblies (10). Hence, every bulb assemblies (10) are positioned on both sides of the light string, which has an outlook as a string of firecrackers.

Figure 3:
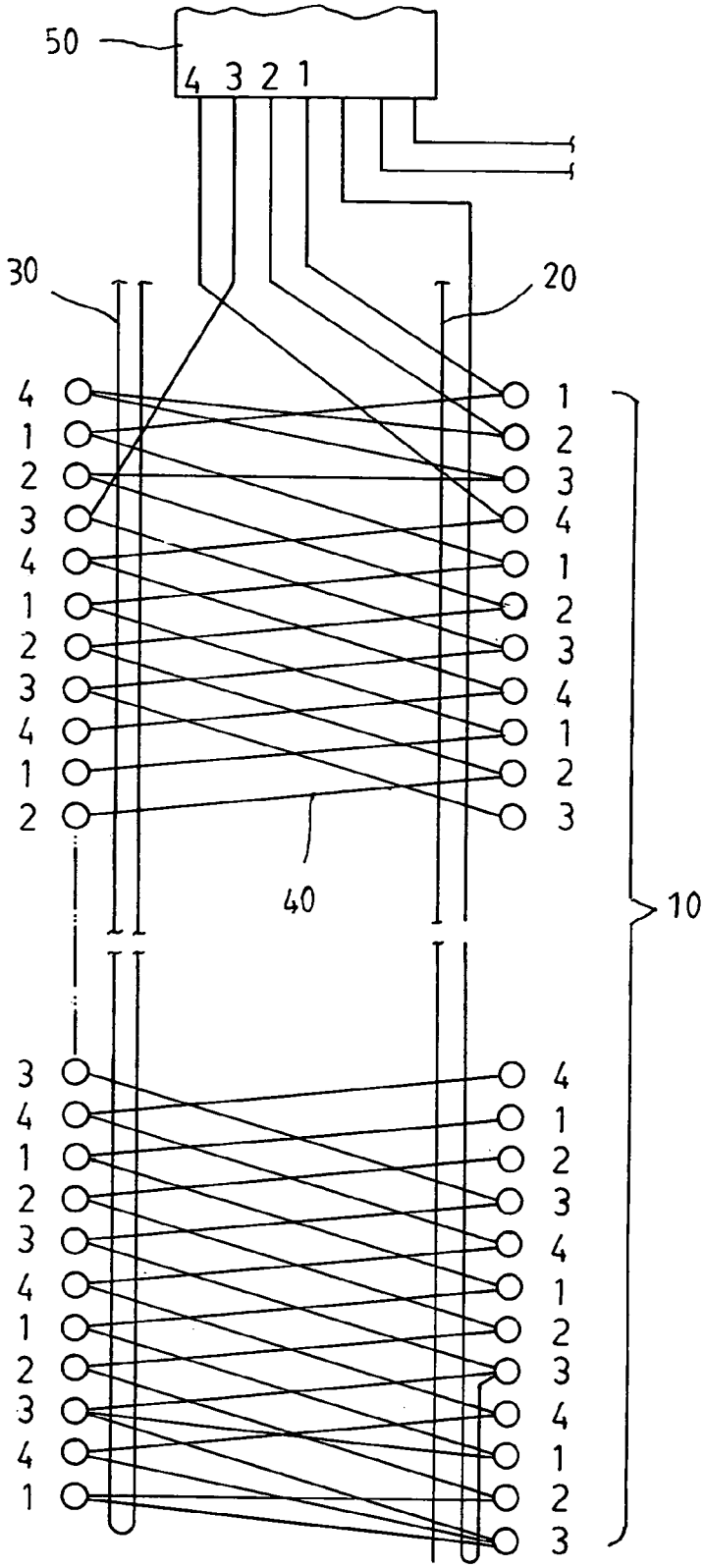
FIG. 3 is plan view showing another embodiment of the light string having a controller.

FIG. 3 shows another embodiment of this application. A controller (50) is provided to connect with the electrical wires (40) of the light string that obtains a different lighting effect.

Accordingly, the present invention uses the blind wires to connect with the electrical wires for placing the bulb assemblies on both sides of the light string. It can display a certain decorative outlook, such as a string of firecrackers without any extra supporting frame. It can be understood that the present invention includes improvement and utilization with no doubt and is obviously allowable.

I claim:

1. A firecracker-like light string comprising: a plurality of electrical wires having a plurality of bulb assemblies on opposing sides thereof; a plurality of blind wires coupled to said plurality of electrical wires at inner portions of said plurality of bulb assemblies; and, a plurality of twisted wire pair portions each including at least one said blind wire and defining a plurality of loops, said bulb assemblies being retentively positioned respectively through said loops, wherein the firecracker-like light string forms a spiral contour.

2. The firecracker-like light string as claimed in claim 1, further comprising a controller coupled to said plurality of electrical wires for controlling the lighting of said bulb assemblies.

* * * * *